US009605457B2

(12) United States Patent
Humble

(10) Patent No.: US 9,605,457 B2
(45) Date of Patent: Mar. 28, 2017

(54) THREE-DIMENSIONALLY ADJUSTABLE PIVOT DEVICE

(76) Inventor: Steven Humble, Tempe, AZ (US)

( * ) Notice: Subject to any disclaimer, the term of this patent is extended or adjusted under 35 U.S.C. 154(b) by 188 days.

(21) Appl. No.: 12/261,018

(22) Filed: Oct. 29, 2008

(65) Prior Publication Data

US 2016/0208532 A1 Jul. 21, 2016

(51) Int. Cl.
*E05D 7/04* (2006.01)

(52) U.S. Cl.
CPC ..... *E05D 7/04* (2013.01); *E05D 7/0423* (2013.01); *E05D 2007/0476* (2013.01); *E05D 2007/0492* (2013.01); *E05Y 2201/638* (2013.01); *E05Y 2600/10* (2013.01); *E05Y 2600/12* (2013.01); *E05Y 2600/502* (2013.01); *E05Y 2600/634* (2013.01); *E05Y 2900/102* (2013.01); *E05Y 2900/132* (2013.01); *E05Y 2900/142* (2013.01); *E05Y 2900/21* (2013.01); *Y10T 16/53225* (2015.01)

(58) Field of Classification Search
CPC .... E05D 2007/0036; E05D 2007/0063; E05D 2007/0072; E05D 2007/0081; E05D 2007/0438; E05D 2007/0446; E05D 2007/0453; E05D 2007/0461; E05D 2007/0469; E05D 2007/0476; E05D 2007/0484; E05D 2007/0492; E05D 2011/1092; Y10T 16/532–16/5329
See application file for complete search history.

(56) References Cited

U.S. PATENT DOCUMENTS 1,216,169 A * 2/1917 Rochester ..... E05D 7/0407 16/238
1,668,839 A * 5/1928 Cureton ..... F16C 17/08 16/238
2,184,532 A * 12/1939 Schroeder ..... E05D 7/081 16/236
2,554,540 A * 5/1951 Polson ..... E05F 1/1253 16/245
2,657,421 A * 11/1953 Polson ..... E05D 7/0423 16/238
2,725,589 A * 12/1955 Papesh ..... E05D 5/023 16/236
3,251,090 A * 5/1966 Fergison ..... E05D 15/266 16/238
3,584,332 A * 6/1971 Taylor ..... E05D 15/266 16/245

(Continued)

*Primary Examiner* — Jeffrey O Brien
(74) *Attorney, Agent, or Firm* — Jeffrey Parry Intellectual Property Law Group PLLC; Jeffrey C. Parry

(57) ABSTRACT

A three-dimensionally adjustable hinge receives a pivotable element. A housing has an adjustable pivot support block inside adjusted in two directions by bolts extending through different walls of the housing and threaded into the pivot support to move the block in two different directions by turning the two different bolts. A supporting wedge with a threaded bolt moves the block the box-like enclosure in a third direction. Alternately, stacked adjusting plates with longitudinal bolts threaded through threaded openings in center sliders move the sliders in center slots aligned in different directions in the different plates to adjust a pivotable element attached to a top plate in two different directions. The plate assembly is pivotally attached to a base by an adjustable height bolt assembly for adjustment in a third direction.

6 Claims, 6 Drawing Sheets

(56) References Cited

U.S. PATENT DOCUMENTS 4,330,901 A * 5/1982 Sanders ..... E05D 7/0009 16/237
4,646,472 A * 3/1987 Sugawara ..... E05F 1/123 16/238
4,720,896 A * 1/1988 Lautenschlager ..... E05D 5/0276 16/236
5,203,115 A * 4/1993 Marinoni ..... E05D 5/0246 16/236
5,694,665 A * 12/1997 Strickland ..... E05D 7/0423 16/237
5,799,370 A * 9/1998 Davidian ..... E05D 7/0415 16/236
6,276,025 B1 * 8/2001 Leibman ..... E05D 5/06 16/240
6,434,791 B1 * 8/2002 Chung ..... E05D 7/0423 16/251
6,802,106 B2 * 10/2004 Taglianetti ..... E05D 7/0045 16/238
7,017,231 B2 * 3/2006 Isele ..... E05D 7/0407 16/236
7,269,880 B2 * 9/2007 Wallis ..... E05D 7/0027 16/237
7,334,293 B2 * 2/2008 Erickson ..... E05D 7/0423 16/243
7,350,272 B2 * 4/2008 Fries ..... E05D 7/02 16/236
7,490,384 B2 * 2/2009 Lee ..... E05D 5/121 16/235
7,516,516 B2 * 4/2009 Wu ..... E05D 7/0415 16/238
7,552,511 B2 * 6/2009 Campbell ..... E05D 7/0423 16/236
7,584,523 B1 * 9/2009 Finkelstein ..... E05D 7/0423 16/260
7,594,301 B2 * 9/2009 Krajenke ..... E05D 7/0423 16/235
7,617,567 B2 * 11/2009 Franchini ..... E05D 7/04 16/236
7,870,642 B1 * 1/2011 Finkelstein ..... E05D 7/0423 16/242
7,895,713 B2 * 3/2011 Williams, Jr. ..... E05D 5/06 16/238
8,020,253 B1 * 9/2011 Finkelstein ..... E05D 7/0423 16/250
8,079,114 B2 * 12/2011 Fries ..... E05D 7/02 16/235
8,276,241 B2 * 10/2012 Wu ..... E05D 7/0415 16/235
8,413,299 B2 * 4/2013 Bartels ..... E05D 7/0423 16/236
8,490,246 B2 * 7/2013 Waddell ..... E05D 7/0423 16/238
8,528,169 B1 * 9/2013 Yu ..... E05F 3/20 16/238
8,650,712 B2 * 2/2014 Wach ..... E05D 7/0415 16/236
8,683,651 B2 * 4/2014 Liermann ..... E05D 7/04 16/235
8,707,521 B1 * 4/2014 Mack ..... E05D 11/06 16/326
8,720,008 B2 * 5/2014 Dodge ..... E05D 7/0423 16/236
8,739,367 B2 * 6/2014 Park ..... E05D 5/06 16/240
8,800,109 B1 * 8/2014 Mitchell ..... E05D 11/0054 16/238
8,881,346 B2 * 11/2014 Oshima ..... E05D 7/0407 16/236
9,038,242 B2 * 5/2015 Chung ..... E05D 7/0415 16/240
9,181,739 B2 * 11/2015 Baer ..... E05D 3/122
9,395,089 B2 * 7/2016 Nelson ..... E05D 7/0045
9,422,756 B2 * 8/2016 Bacchetti ..... E05D 11/0054
2001/0025396 A1 * 10/2001 Sitter ..... E05D 7/04 16/221
2002/0073509 A1 * 6/2002 Dean ..... E05D 7/0415 16/387
2004/0163211 A1 * 8/2004 Rucker ..... E05D 7/0415 16/235
2005/0183238 A1 * 8/2005 McCue ..... E05D 7/0027 16/236
2006/0137139 A1 * 6/2006 Wu ..... E05D 7/0415 16/236
2006/0143859 A1 * 7/2006 Wu ..... E05D 7/0415 16/242
2008/0307606 A1 * 12/2008 Karlsson ..... E05D 7/0415 16/243
2011/0296652 A1 * 12/2011 Zhang ..... E05D 7/0027 16/239
2012/0005859 A1 * 1/2012 Herglotz ..... E05D 7/0415 16/241
2012/0102674 A1 * 5/2012 King ..... E05D 7/0027 16/237
2014/0215923 A1 * 8/2014 Gompper ..... E05D 7/0054 49/381
2016/0047151 A1 * 2/2016 Pelekanos ..... E05D 7/0045 16/238
2016/0123056 A1 * 5/2016 Polo Friz ..... E05D 3/186 16/250
2016/0281403 A1 * 9/2016 Arai ..... E05D 7/0407

* cited by examiner

THREE-DIMENSIONALLY ADJUSTABLE PIVOT DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

Field of the Invention

One embodiment of the present invention relates to adjustable hinges and particularly to a three-dimensionally adjustable pivot device for receiving a swivel pin from a pivotable element, the hinge comprising a box-like housing having a plurality of apertures therethrough, a swivel pin receiver and swivel pin receiver block inside the housing, a pin receiving bore in the block for receiving a swivel pin of a door or other pivotable element, a first threaded adjusting device which travels through a first set of apertures in the housing to adjust the block in a first direction, a second threaded adjusting device which travels through a second set of apertures in the housing to adjust the block in a second direction, a ramp-like adjuster to move the swivel pin receiver within the swivel pin receiver block in a vertical direction, and a third threaded adjusting device for moving the ramp-like adjuster and thereby causing vertical movement of the swivel pin receiver.

Description of Related Art Including Information Disclosed Under 37 CFR 1.97 and 1.98

Concealed passageways through walls require great precision and adjustability in the hinges in order to have the passageway section of the wall close precisely to give the appearance of an unbroken wall with no indication of the existence of the passageway. Other very heavy or thick doors would also benefit from hinges which are adjustable in three dimensions for precision opening and closing, especially doors which require a tight seal when closed. Particular applications might include cold room doors, safe doors, clean room doors or any other type of door requiring precision in opening and closing.

Door alignment devices are known in the prior art, most of which have an adjustable door check with a spindle on which the door sits. Prior art patents fail to provide door or wall passage pivots which are adjustable in all three dimensions.

U.S. Pat. No. 2,184,532, issued Dec. 26, 1939 to Schroeder, provides an adjustable pivot member for swinging doors which comprises an adjustable base that is rigidly secured to the floor and which has mounted therein a door-supporting rod. The adjustable base allows the pivot axis of the door-supporting rod to be adjusted, thereby making adjustments to correct misalignment of the door.

U.S. Pat. No. 4,646,472, issued Mar. 3, 1987 to Sugawara, claims a door fitting device capable of adjusting an axis of rotation and torque, which makes it possible to connect easily a torsion bar and a worm wheel and to engage the worm wheel with a worm. The door fitting device itself can be assembled easily and rapidly in parallel with fitting of the door to an upper and lower frame.

U.S. Pat. No. 3,251,090, issued May 17, 1966 to Fergison, describes a hinge assembly for folding doors wherein a pivot pin extends from the door and engages the adjustable hinge assembly. The hinge is adjusted by turning a shaft having teeth thereon which moves and aligns the door. The hinge can compensate for any out-of-square movement of the supported door panel and then can positively lock it in place.

Two U.S. Pat. No. 2,554,540 issued May 29, 1951 and U.S. Pat. No. 2,657,421 issued Nov. 3, 1953 to Polson, disclose an adjustable hinge. A door has an upper retractable spindle and a lower adjustable spindle which seats in a spring actuated closure device.

U.S. Pat. No. 1,668,839, issued May 8, 1928 to Cureton, indicates an adjustable step bearing.

U.S. Pat. No. 5,203,115, issued Apr. 20, 1993 to Marinoni, puts forth a door aligning device. The invention relates to a door having at least one wing which can be swiveled about a lower hinge axis of a bearing device of a lower door rail, and about an upper hinge axis of a bearing device of an upper door rail relative to a door closer disposed within an upper tubular door frame. The upper hinge axis is defined by an adjustable first hinge part which is disposed on the outside of an upper wing frame section and which is capable of swiveling in a limited fashion about an essentially vertical alignment axis, and by a second hinge part which is essentially horizontally displaceable 1) in a limited fashion on the first hinge part and 2) essentially parallel to the plane of the wing. The first and second hinge parts are capable of being fixed in place.

What is needed is a pivot box for a pivotable closure that is adjustable in three dimensions for a precise fit of the pivotable closure in the wall and smooth travel.

BRIEF SUMMARY OF THE INVENTION

An object of one embodiment of the present invention is to provide a pivot box for a pivotable closure that is adjustable in three dimensions for a precise fit of the pivotable closure in the wall and smooth travel.

In brief, one embodiment of the present invention comprises a three-dimensionally adjustable pivot for receiving a swivel pin from a pivotable element. The pivot comprising a box-like housing having a plurality of apertures therethrough, a swivel pin receiver block inside the housing space apart from the walls of the housing, and a swivel pin receiver having a pin receiving bore for receiving a swivel pin of a door, wall section, or other pivotable element through a housing opening. A first threaded adjusting device travels through a first set of apertures in the housing to adjust the block in a first direction. A second threaded adjusting device travels through a second set of apertures in the enclosure to adjust the block in a second direction. A ramp-like adjuster underneath the swivel pin receiver in the block adjusts the swivel pin receiver in a vertical direction within the block, wherein a third threaded adjusting device moves a wedge relative to a ramped bottom surface of the swivel pin receiver for precision vertical adjustment of the swivel pin receiver.

One embodiment of the present invention is particularly effective for concealed passageways through walls which require great precision and adjustability in the hinges in order to have the passageway section of the wall close precisely to give the appearance of an unbroken wall with no indication of the existence of the passageway. Other very heavy or thick doors would also benefit from hinges which are adjustable in three dimensions for precision opening and closing, especially doors which require a tight seal when closed. Particular applications might include cold room doors, safe doors, clean room doors or any other type of door requiring precision in opening and closing.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
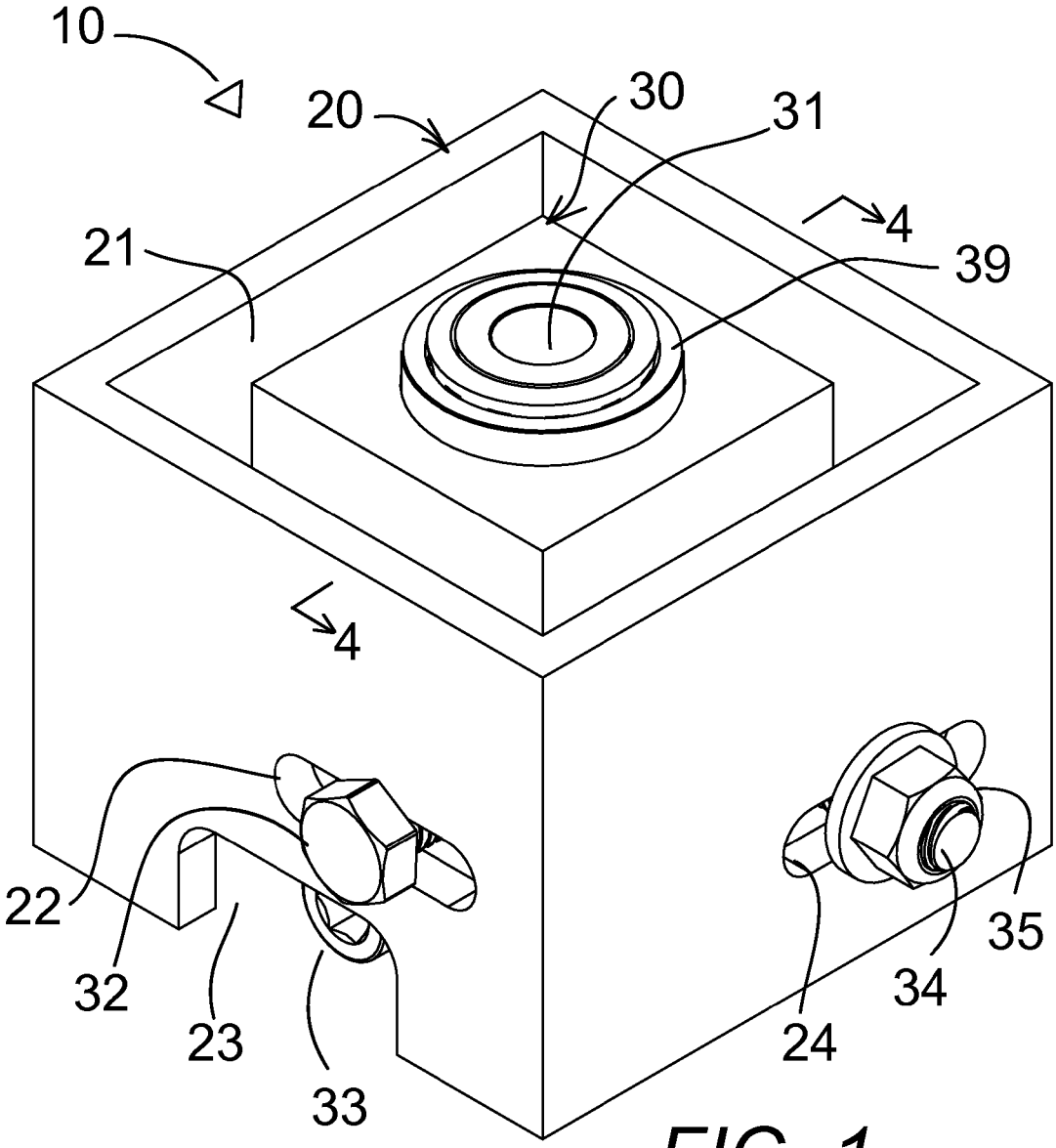
FIG. 1 is a perspective view of the pivot device of one embodiment of the present invention showing the swivel pin receiver and receiver block inside the pivot housing with the pin receiving bore exposed through a top housing opening to receive a swivel pin from a pivotable element and showing the three threaded adjusting shafts which provide precision adjustment of the swivel pin receiver and swivel pin receiver block in three dimensions.
Figure 2:
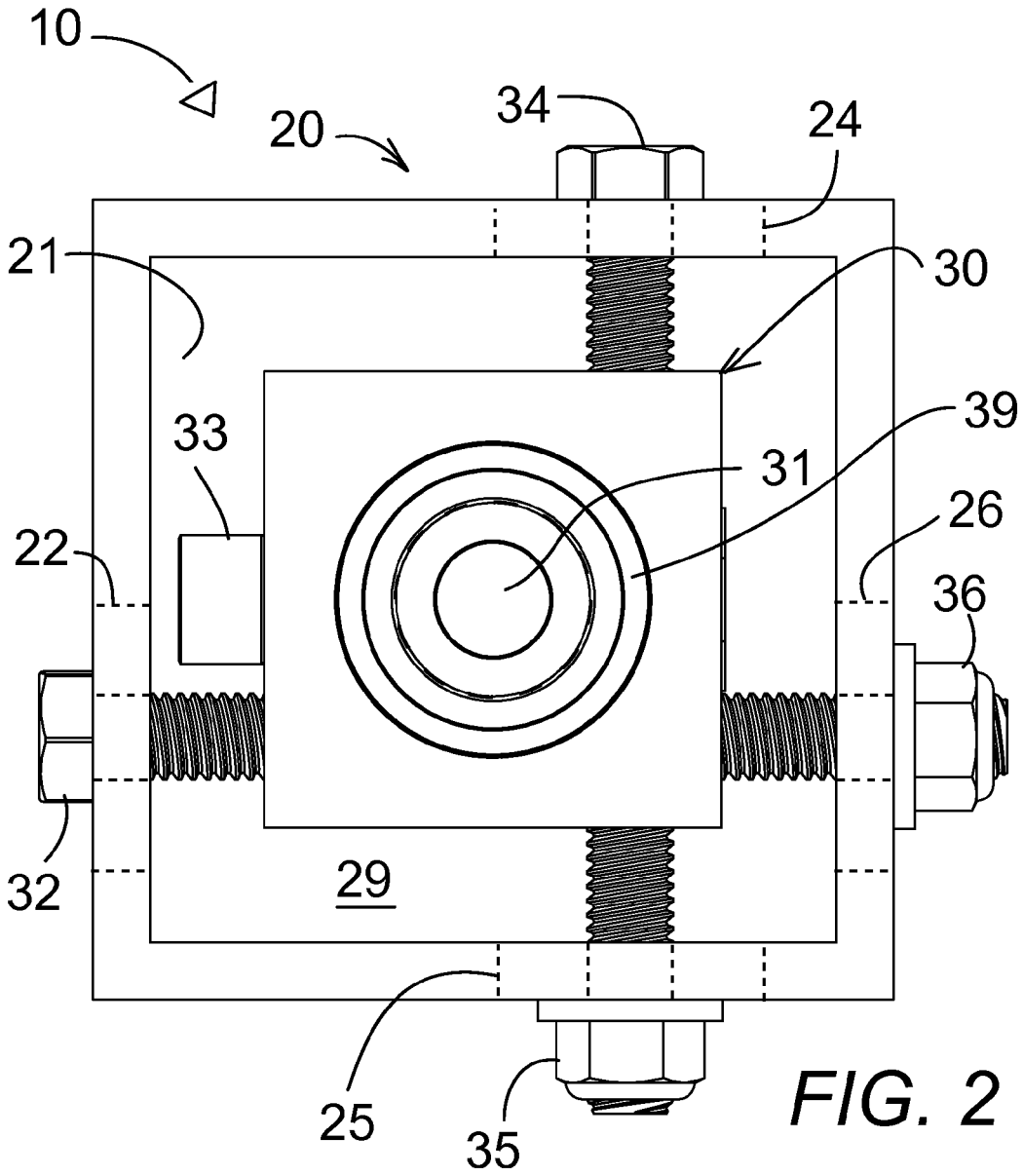
FIG. 2 is a top plan view of the pivot device of FIG. 1.

In FIGS. 1-9, a pivot device 10 and 10A provides precision adjustment in multiple directions. The device comprises means for supporting a pivotable element, such as a door, for allowing pivoting of the pivotable element and means for adjusting the means for supporting the pivotable element in multiple directions to adjust the position of the pivotable element for a desired angle of pivot of the pivotable element and a desired angle and rest position of the pivotable element, thereby providing a pivot device providing precision adjustment in multiple directions.

In FIGS. 1-4, the pivot device 10 providing precision adjustment in multiple directions comprises an outer pivot housing 20, an inner swivel pin receiver 39 and swivel pin receiver block 30 which are adjustable in three directions.

The pivot housing 20 rests on an exterior surface. The pivot housing 20 has peripheral surfaces 28 housing an interior space 29 with a housing swivel pin opening 21 through one of the peripheral surfaces, usually a top surface.

The swivel pin receiver 39 and swivel pin receiver block 30 housed within the interior space 29 of the pivot housing spaced apart from the peripheral surfaces 28 so that the swivel pin receiver 39 and swivel pin receiver block 30 is movable in multiple directions within the pivot housing 20. The swivel pin receiver 39 having a pin receiving bore 31 therein for receiving a swivel pin from a pivotable element, such as a door or pivotable wall section. The swivel pin receiver block 30 is positioned within the pivot housing 20 so that a swivel pin fits through the housing swivel pin opening 21 and into the pin receiving bore 31 to allow the swivel pin to pivot within the pin receiving bore so that the pivotable element pivots, such as a door or wall section opening and closing.

The means for moving the swivel pin receiver 39 and swivel pin receiver block 30 adjustably in multiple directions within the pivot housing 20 to adjust the orientation of the pivotable element for a desired angle of pivot of the pivotable element and a desired angle and position of rest of the pivotable element comprises adjustable threaded pins 32, 33, and 34, thereby providing a pivot device providing precision adjustment of the swivel pin receiving block in three directions, normally two orthogonal horizontal directions and a vertical direction. Other means for moving the swivel pin receiver block and the swivel pin receiver adjustably in multiple directions may comprise a hydraulic vertical adjuster like a mini car jack, or may comprise having the parts travel loosely by hand until in the proper adjustment is reached when everything could be tightened down, or may comprise having the parts move using a tiny ratcheted lever.

The means for moving the swivel pin receiving block adjustably in two orthogonal directions, normally horizontal directions, comprises two pair of spaced parallel peripheral surfaces 28 of the pivot housing, each peripheral surface having a horizontal slot opening 22 and 24 mating with a slot opening 25 and 26 in the parallel peripheral surface, each pair of parallel peripheral surfaces orthogonal to the other pair. A pair of orthogonal threaded shafts 32 and 34, such as bolts, held to the pivot housing by threaded nuts 35 and 36, each interact with the swivel pin receiver block 30 to adjust the swivel pin receiver block in two orthogonal directions, normally horizontally. Each shaft passes through the swivel pin receiver block 30 with a shaft end extending out of each of two opposing faces of the swivel pin receiver block 30 and each shaft end passing through one of the two aligned horizontal slot openings either 22 and 25 or 24 and 26, to allow movement in the slot opening so that each of the shafts can be moved in the mating slot openings in one of two orthogonal directions and the shaft secured in the slot by a threaded fastener thereby adjusting the location of the swivel pin receiver block 30 in each of two orthogonal directions within the pivot housing.

Figure 3:
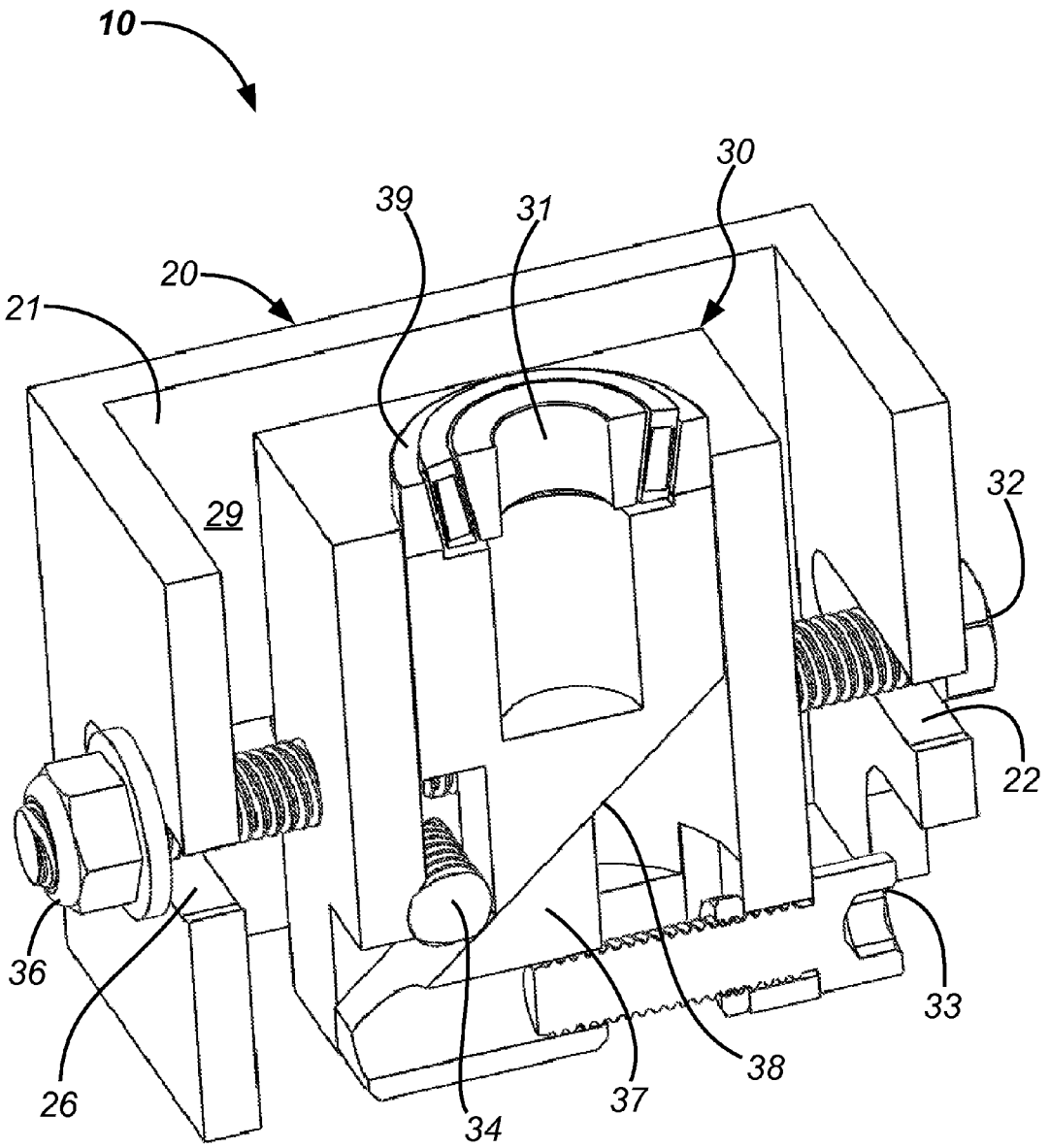
FIG. 3 is a perspective view in partial section of the pivot device of FIG. 1 showing the two horizontal adjusting bolts for precision horizontal adjustment of the swivel pin receiver block in two orthogonal directions and the wedge and threaded shaft underneath the swivel pin receiver for precision vertical adjustment of the swivel pin receiver within the swivel pin receiver block.
Figure 4:
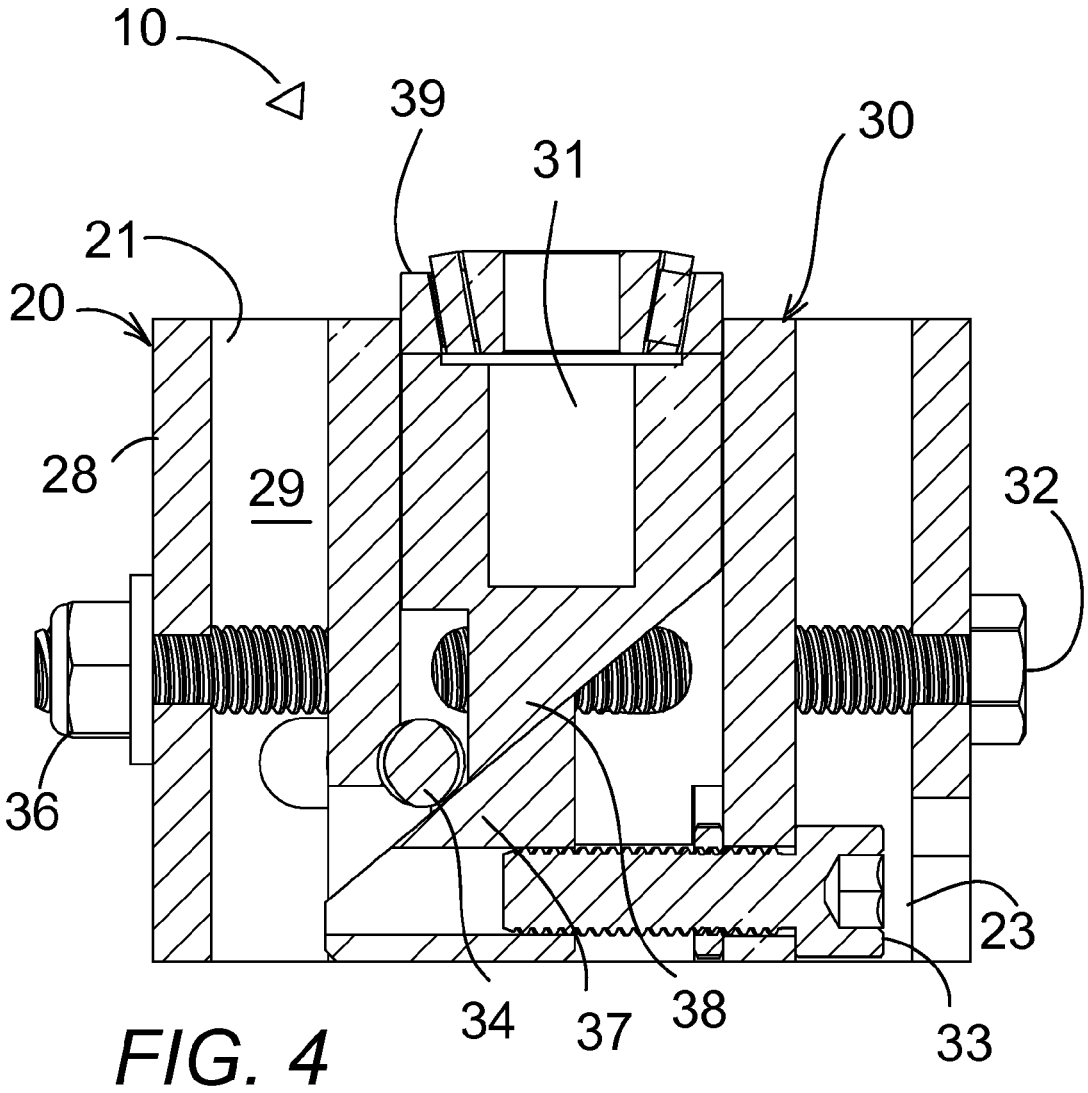
FIG. 4 is an elevational cross-sectional view of the pivot device taken through 4-4 of FIG. 1 showing the two horizontal adjusting bolts for precision horizontal adjustment of the swivel pin receiver block in two orthogonal directions and the wedge and threaded shaft underneath the swivel pin receiver for precision vertical adjustment of the swivel pin receiver within the swivel pin receiver block.
Figure 5:
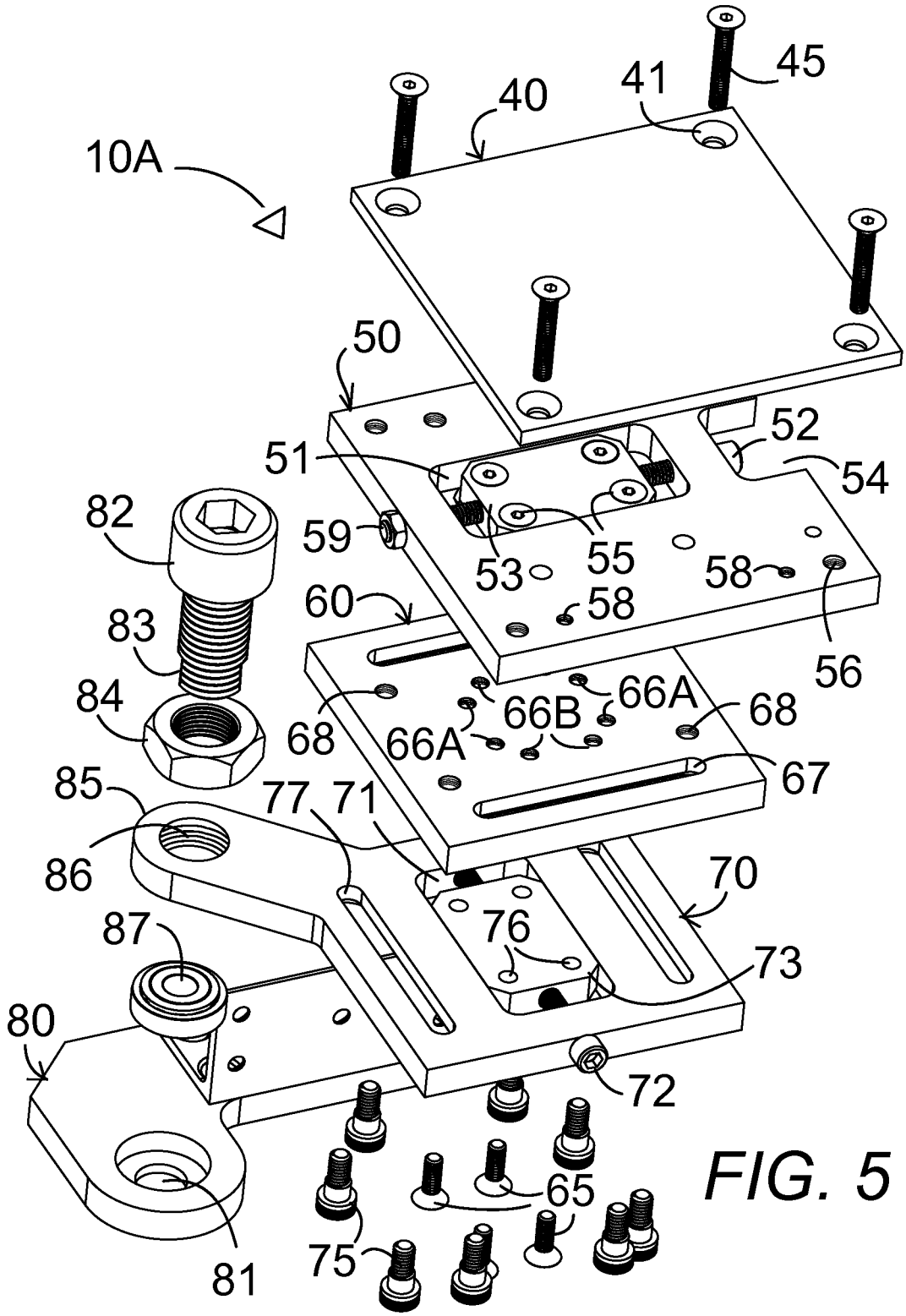
FIG. 5 is an exploded perspective view of an alternate embodiment of the present invention having a series of directionally adjusting plates and connecting plates pivotally attached to a base plate by an adjustable height pivot assembly.
Figure 6:
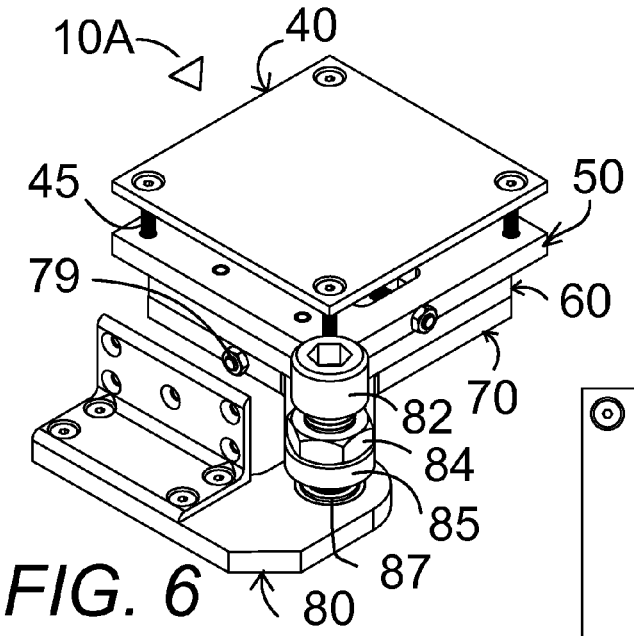
FIG. 6 is a perspective view of the alternate embodiment of the present invention of FIG. 5 showing the series of directionally adjusting plates and connecting plates pivotally attached to a base plate by an adjustable height pivot assembly assembled for use.
Figure 7:
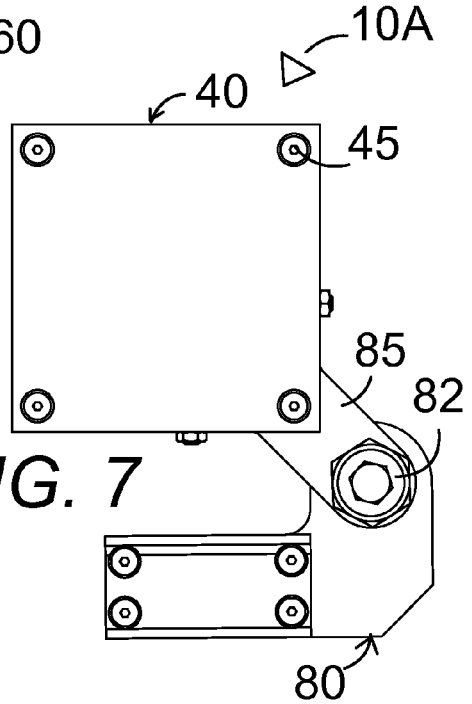
FIG. 7 is a top plan view of the alternate embodiment of the present invention of FIG. 5 showing the series of directionally adjusting plates and connecting plates pivotally attached to a base plate by an adjustable height pivot assembly assembled for use.
Figure 8:
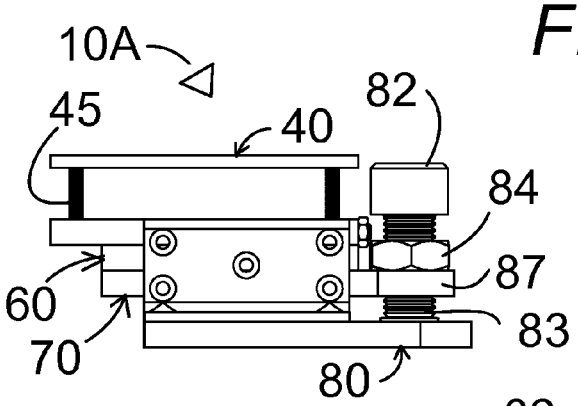
FIG. 8 is a side elevational view of the alternate embodiment of the present invention of FIG. 5 showing the series of directionally adjusting plates and connecting plates pivotally attached to a base plate by an adjustable height pivot assembly assembled for use.
Figure 9:
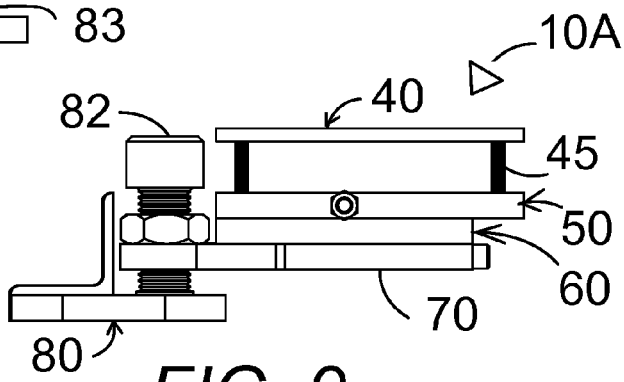
FIG. 9 is a side elevational view of the alternate embodiment of the present invention of FIG. 5 viewed orthogonally to the view of FIG. 8, showing the series of directionally adjusting plates and connecting plates pivotally attached to a base plate by an adjustable height pivot assembly assembled for use.

In FIGS. 3 and 4, the housing opening 21 is normally through a peripheral surface orthogonal to each of the two pair of spaced parallel orthogonal surfaces 28, in this case shown as a top opening 21 with the orthogonal surfaces positioned vertically, and the swivel pin receiver 39 further comprises a sloping surface 38, shown on the bottom in this case, opposite to the housing opening 21, and the means for moving the swivel pin receiver 39 vertically toward and away from the housing opening further comprises a wedge 37 and a wedge threaded shaft 33 connected between the wedge and a mating threaded opening through the swivel pin receiver block 30, so that adjusting the wedge threaded shaft 33 adjusts the movement of the wedge 37 relative to the swivel pin receiver sloping surface 38 causing the swivel pin receiver 39 to be precisely adjusted vertically, toward and away from the housing opening 21, thereby adjusting the position of the external pivotable element to move it closer to or further away from the pivot housing 20.

While the pivot device 10 of the present invention may be positioned in any needed direction for pivotable elements such as angled hatch openings, normally the pivot housing 20 rests on a horizontal surface with the housing opening 21 at the top and the wedge 38 positioned underneath the swivel pin receiver 39 so that the swivel pin receiver block 30 is adjustable in two orthogonal horizontal directions and the swivel pin receiver 39 is adjustable in a vertical direction, thereby providing a pivotable element pivot device 10 adjustable in the x, y, and z directions.

The pivotable element may comprise a pivotable section of a wall, wherein the pivot device 10 rests within the confines of the pivotable section of wall not visible through the section of wall, so that adjusting the pivot device in the x, y, and z directions aligns the movable wall to mate evenly with the rest of the wall and to align evenly with the floor so that the movable section of wall appears to be part of the wall when closed. The pivotable section of wall may comprise an entrance to a concealed passageway through the wall.

In addition to the movable section of wall the present invention may be used with any desired pivotable element which may comprise any of the pivotable elements taken from the list of pivotable elements comprising a hidden vault cover, a heavy door, a thick door, a tight seal door, a cold room door, a safe door, a clean room door, or any door requiring precision in opening and closing.

In FIG. 5-9, the pivot device 10A means for supporting the pivotable element comprises a support plate 40 attached to the pivotable element and the means for adjusting the support plate comprises a first adjusting plate 50 connected to the support plate 40 by threaded fasteners 45 in threaded openings 56 for adjusting the support plate in at least one first direction, a second adjusting plate 70 connected to the first adjusting plate 50 by a connecting plate 60 for adjusting the first adjusting plate 50 and the support plate 40 in at least one second direction different from the first direction, and a pivot device 82-87 in a base plate 80 attached to the second adjusting plate 70 for adjusting the second adjusting plate 70 in at least one third direction different from the first direction and second direction so that the plates pivot about the pivot device 87 allowing the pivotable element to pivot and the pivotable element is adjustable in three different directions.

Each of the adjusting plates 50 and 70 comprises a center slider 53 and 73 respectively, in a center slot 51 and 71 respectively in the adjusting plate. The first center slider 53 in the first center slot 51 is aligned in the first direction and the second center slider 73 in the second center slot 71 is aligned in the second direction. A connecting plate 60 is sandwiched between and attached to both the first center slider 53 and the second center slider 73. Each of the sliders is attached to the connecting plate 60 by set screws 55 from the first slider 53 into threaded holes 66B in the connecting plate 60 and set screws 65 from holes 76 in the second center slider 73 into threaded holes 66A in the connecting plate 60 so that the motion of the second center slider 73 in the second center slot 71 moves the connecting plate 60 and the first adjusting plate 50 and the attaching plate 40, and hence the pivoting element, in the second direction and movement of the first adjusting plate 50 relative to the first slider 53 moves the support plate 40, and hence the pivoting element, in the first direction.

A long bolt 52 and 72 with a head protrudes outside the adjusting block at a first end (within the recessed space 54 in the end of the first adjusting block 50), and a nut 59 and 79 protrudes outside the adjusting block at a second end, the long bolt 52 and 72 extending longitudinally through the length of each of the adjusting plates 50 and 70 and through each of the center slots 51 and 71 and through each of the center sliders 53 and 73 with a threaded connection to only the center sliders 53 and 73 so that turning the bolt 52 and 72 causes the center slider 53 and 73 to slide within the center slot 51 and 71.

The first long bolt 52 aligned in the first direction extending through the first adjusting plate 50 when the first long bolt is turned causes the first adjusting plate 50 to move relative to the first slider 53 (which is held stationary by the connecting plate 60 causing the attaching plate 40 and the attached pivoting element to adjust in the first direction.

The second long 72 bolt is aligned in the second direction extending through the second adjusting plate 70. When the second long bolt 72 is turned it causes the second center slider 73 to move in the second direction (with the second adjusting plate held stationary by the pivoting assembly 82-87 and the base plate 80) thereby causing the interconnected connecting plate 60, first adjusting plate 50, attaching plate 40 and attached pivotable element to adjust in the second direction.

Precision movement of the first adjusting plate 50 relative to the connecting plate 60 is assisted by partially threaded bolts 75 connected between the connecting plate 60 into threaded holes 58 in the first adjusting plate 50 and sliding in parallel spaced grooves 67 in the connecting plate 60 as well as the sliding friction fit between the center slider 53 in the center slot 51 of the first adjusting plate 50.

Precision movement of the connecting plate 60 relative to the second adjusting plate 70 is assisted by partially threaded bolts 75 threaded into threaded openings 68 in the connecting plate and sliding in parallel spaced grooves 77 in the second adjusting plate 70 as well as the sliding friction fit of the center slider 73 in the center slot 71 of the second adjusting plate 70.

The second adjusting plate 70 is pivotally attached to the base plate 80 by a pivot assembly 82-87 comprising an extremely large hex cap screw 82 which is turned down to a smaller diameter 83 at the end so that it fits in the radial thrust bearing or other pivot device 87 in the stepped opening 81 in the base plate 80 holding the pivot assembly. The smaller-diameter tip 83 holds the radial load while the shoulder of the stepped opening 81 holds the thrust load. The second adjusting plate 70 has an extending neck 85 with a large hole 86 cut in it for the massive hex cap screw 82 to fit through. The large hole 82 is threaded so that the second adjusting plate 70 (with the rest of the pivot set and other plates) can be raised and lowered by turning the hex cap screw 82 to adjust the entire assembly of plates and the pivoting element in the third direction. When at the right height, the jam nut 84 can be tightened on to it, holding it in place.

In use, for the embodiment of FIGS. 5-9, rotating the first long bolt 52, recessed in the end opening 54, of the first adjusting plate 50, causes the outer adjusting plate 50 to move relative to the center slider 53 (held by the connecting plate 60) to adjust the attached attaching plate 40 and pivoting element in the first direction. Rotating the second long bolt 72 of the second adjusting plate 70 causes the center slider 73 to move relative to the second adjusting plate 70 (held by the pivoting assembly 80) to adjust the interconnected assembly of the connecting plate 60, the first adjusting plate 50, the attaching plate 40 and the pivoting element in the second direction.

For adjustment in the third direction, the extremely large hex cap screw 82 is turned down to a smaller diameter 83 at the end so that it fits in the radial thrust bearing or other pivot device 87 in the stepped opening 81 in the base plate 80 holding the pivot assembly. The smaller-diameter tip 83 holds the radial load while the shoulder of the stepped opening 81 holds the thrust load. The second adjusting plate 70 has an extending neck 85 with a large hole 86 cut in it for the massive hex cap screw 82 to fit through. The large hole 82 is threaded so that the second adjusting plate 70 (with the rest of the pivot set and other plates) can be raised and lowered by turning the hex cap screw 82. When at the right height, the jam nut 84 can be tightened on to it, holding it in place.

It is understood that the preceding description is given merely by way of illustration and not in limitation of the invention and that various modifications may be made thereto without departing from the spirit of the invention as claimed.

What is claimed is:

1. A pivot device providing precision adjustment in multiple directions, the device comprising:

a base plate;

a support plate for supporting a pivotable element, the support plate pivotally connected to the base plate;

an adjustment mechanism for adjusting the support plate in multiple directions with respect to the base plate for adjusting the position of the pivotable element, wherein the adjustment mechanism comprises:

a first adjusting plate, a second adjusting plate, a support plate, and an adjustable pivot assembly;

the first adjusting plate comprises a first center slider in a first center slot, the first center slot aligned in a first direction, the first adjusting plate is fixed to the support plate for adjusting the support plate in the first direction with respect to the base plate;

a first bolt extends longitudinally in the first direction through the first adjusting plate, through the first center slot, and through the first center slider with a threaded connection to the first center slider so that turning the first bolt causes the first center slider to slide within the first center slot;

the second adjusting plate comprises a second center slider in a second center slot, the second center slot aligned in a second direction substantially orthogonal to the first direction;

a second bolt extends longitudinally in the second direction through the second adjusting plate, through the second center slot, and through the second center slider with a threaded connection to the second center slider so that turning the second bolt causes the second center slider to slide within the second center slot;

the connecting plate sandwiched between and attached to both the first center slider and the second center slider, each of the first and second center sliders attached to the connecting plate so that turning the second bolt causes movement of the second center slider in the second center slot which moves the connecting plate, the first adjusting plate, and the support plate in the second direction, and turning the first bolt causes movement of the first adjusting plate relative to the first slider which moves the support plate in the first direction;

the adjustable pivot assembly attached to the second adjusting plate for adjusting the second adjusting plate in a third direction substantially orthogonal to both the first direction and the second direction; and the adjustable pivot assembly comprises a pivot screw which is turned down to a smaller diameter at a distal end, the distal end fitting pivotally into a pivot socket of the base plate, the pivot screw threaded into a threaded opening in the second adjusting plate so that the second adjusting plate is adapted to be raised and lowered by turning the pivot screw to adjust the entire assembly of plates and the pivotable element in the third direction.

2. The pivot device of claim 1 wherein the pivot socket further comprises a radial thrust bearing.

3. The pivot device of claim 1 wherein the second adjusting plate further comprises an extension arm extending from the plate, the threaded opening formed in the extension arm.

4. The pivot device of claim 1 wherein movement of the first adjusting plate relative to the connecting plate is assisted by partially threaded bolts threaded into threaded opening in the first adjusting plate and sliding in parallel spaced grooves in the connecting plate.

5. The pivot device of claim 1 wherein movement of the connecting plate relative to the second adjusting plate is assisted by partially threaded bolts threaded into threaded openings in the connecting plate and sliding in parallel spaced grooves in the second adjusting plate.

6. The pivot device of claim 1 wherein the adjustable pivot assembly further comprises a jam nut threaded on the pivot screw such that the jam nut can be tightened to hold the pivot screw in place.

* * * * *